US008415887B1

(12) United States Patent
Janning

(10) Patent No.: US 8,415,887 B1
(45) Date of Patent: Apr. 9, 2013

(54) TRANSISTOR BYPASS SHUNTS FOR LED LIGHT STRINGS

(71) Applicant: JLJ, Inc., Bellbrook, OH (US)

(72) Inventor: John L. Janning, Bellbrook, OH (US)

(73) Assignee: JLJ, Inc., Bellbrook, OH (US)

( * ) Notice: Subject to any disclaimer, the term of this patent is extended or adjusted under 35 U.S.C. 154(b) by 0 days.

(21) Appl. No.: 13/672,513

(22) Filed: Nov. 8, 2012

Related U.S. Application Data

(60) Provisional application No. 61/716,501, filed on Oct. 20, 2012, provisional application No. 61/717,708, filed on Oct. 24, 2012.

(51) Int. Cl.

| | |
|---|---|
| ***H05B 37/00*** | (2006.01) |
| ***H05B 39/00*** | (2006.01) |
| ***H05B 41/00*** | (2006.01) |
| *G05F 1/00* | (2006.01) |
| *H05B 37/02* | (2006.01) |
| *H05B 39/04* | (2006.01) |
| *H05B 41/36* | (2006.01) |

(52) U.S. Cl.
USPC ..... 315/185 R; 315/294; 315/312

(58) Field of Classification Search ..... None
See application file for complete search history.

(56) References Cited

U.S. PATENT DOCUMENTS

| | | | | |
|---|---|---|---|---|
| 6,084,357 | A | 7/2000 | Janning | |
| 6,580,182 | B2 | 6/2003 | Janning | |
| 6,765,313 | B2 | 7/2004 | Janning | |
| 8,324,820 | B2 | 12/2012 | Janning | |
| 2006/0103320 | A1 * | 5/2006 | Janning | 315/164 |
| 2006/0220585 | A1 * | 10/2006 | Negley et al. | 315/185 R |
| 2007/0273296 | A9 | 11/2007 | Janning | |
| 2008/0150440 | A1 * | 6/2008 | Hsu | 315/191 |
| 2009/0129077 | A1 | 5/2009 | Janning | |
| 2012/0139428 | A1 * | 6/2012 | Grebner et al. | 315/185 R |
| 2012/0229030 | A1 * | 9/2012 | Moskowitz et al. | 315/122 |

* cited by examiner

*Primary Examiner* — Douglas W Owens
*Assistant Examiner* — Dedei K Hammond
(74) *Attorney, Agent, or Firm* — Dickstein Shapiro LLP

(57) ABSTRACT

A shunt for bypassing LEDs in a series wired light string to keep the light string lit in the event of a failure of an LED. In one embodiment, the bypass shunt is a rectifier diode with a very high forward voltage drop ($V_f$). Another embodiment uses a transistor bypass device, where the collector and/or base is used as one terminal of the shunt device and the emitter is used as the opposite terminal. The preferred embodiment is to use the collector and emitter terminals only with the base terminal open.

3 Claims, 5 Drawing Sheets

TRANSISTOR BYPASS SHUNTS FOR LED LIGHT STRINGS

This application claims priority to U.S. Provisional Application. No. 61/716,501, filed Oct. 20, 2012 and U.S. Provisional Application No. 61/717,708, filed Oct. 24, 2012, the disclosures of which are herein incorporated by reference.

FIELD OF THE INVENTION

The present invention relates to a series connected light string and, more particularly to a series connected LED light string with transistor shunts to ensure illumination of the light string in the event an LED becomes inoperable or is missing.

BACKGROUND OF THE INVENTION

Light Emitting Diode (LED) light strings have become quite popular recently for holiday decorating. They are much more energy efficient than incandescent lighting that has been around for many years. Since both the LED and the more conventional incandescent mini-light operate at very low voltage—usually between 2.0 to 3.5 volts—they are wired in electrical series connection with approximately 35 to 50 lights in a light string. As with incandescent lighting, when an LED bulb burns out, is loose or missing from the socket, the entire series light string goes out. To prevent this, bypass shunts can be wired across each LED to continue current through the light string in the event of such a failure.

Various other attempts have heretofore been made to provide various types of shunts in parallel with each series light of a series wired light string, whereby the string will continue to be illuminated whenever a light has burned out, or otherwise provide for an open circuit condition. For example, in Applicant's U.S. Pat. No. 6,580,182, entitled SERIES CONNECTED LIGHT STRING WITH FILAMENT SHUNTING, the disclosure of which is incorporated by reference herein, there is disclosed and claimed therein various novel embodiments which very effectively solve the prior art failures in various new and improved ways. For example, there is disclosed therein a series string of lights powered AC voltage, each light having a silicon type voltage regulating shunting device connected thereacross which has a predetermined voltage regulating value which is greater than the voltage normally applied to said lights, and which said shunt becomes fully conductive only when the peak voltage applied thereacross exceeds its said predetermined voltage switching value, which occurs whenever a light in the string either becomes inoperable for any reason whatsoever, even by being removed or falling from its respective socket, and which circuit arrangement provides for the continued flow of rated current through all of the remaining lights in the string, together with substantially unchanged illumination in light output from any of those remaining operative in the string even though a substantial number of total lights in the string are simultaneously inoperative for any combinations of the various reasons heretofore stated. There is disclosed therein various type of shunting devices performing the above desired end result, including back-to-back Zener, or so-called "avalanche" diodes, non-avalanche bilateral silicon switches, and conventional Zener diodes, one-half of which are electrically connected in one current flow direction and the remaining one-half being electrically connected in the opposite current flow direction.

In U.S. Pat. No. 6,084,357, a series of rectifier diodes are connected in an array across light sockets to continue current flow in the event of a failure. This patent teaches the use of two arrays connected in parallel in opposite electrical directions to simulate counter-connected Zener diodes. U.S. Pat. No. 6,580,182 teaches the use of two counter-connected (back-to-back) Zener diodes across each lamp socket. Other patents teach the use of a single Zener diode as a shunt in an AC rectified DC circuit.

Applicant's U.S. Pat. Nos. 6,084,357; 6,580,182 & 6,765,313 are incorporated here in their entirety. While the circuits disclosed and claimed in those patents offer a vastly superior series connected light string with shunting which avoids much of the disadvantages of the prior art circuits noted above, a further simplified and less expensive circuit would, of course, be desirable. It would also be desirable to provide such a circuit for a LED light string.

It is therefore a principal object of the present invention to provide a simple and inexpensive, and yet highly effective, silicon type shunt, or bypass, for each of a plurality of series connected LEDs.

It is another object of the present invention to provide a new and improved series-connected LED light string which has even much greater desirable features than those previously available, and which utilizes a unique shunting circuit which is of very simple and economical construction and is relatively inexpensive to manufacture in mass quantities, thereby keeping the overall cost of the final product at a much lower cost than heretofore possible.

SUMMARY OF THE INVENTION

The present invention utilizes unique and novel shunts not used or considered before for a series wired light string. One such bypass shunt employs a rectifier diode with a very high forward voltage drop ($V_f$). Another circuit uses a transistor bypass device, where the collector and/or base is used as one terminal of the shunt device and the emitter is used as the opposite terminal. The preferred embodiment is to use the collector and emitter terminals only with the base terminal open.

Other advantages, variations and other features of the invention will become apparent from the drawings, the further description of examples and the claims to follow.

DETAILED DESCRIPTION OF THE PREFERRED EMBODIMENTS

Figure 1:
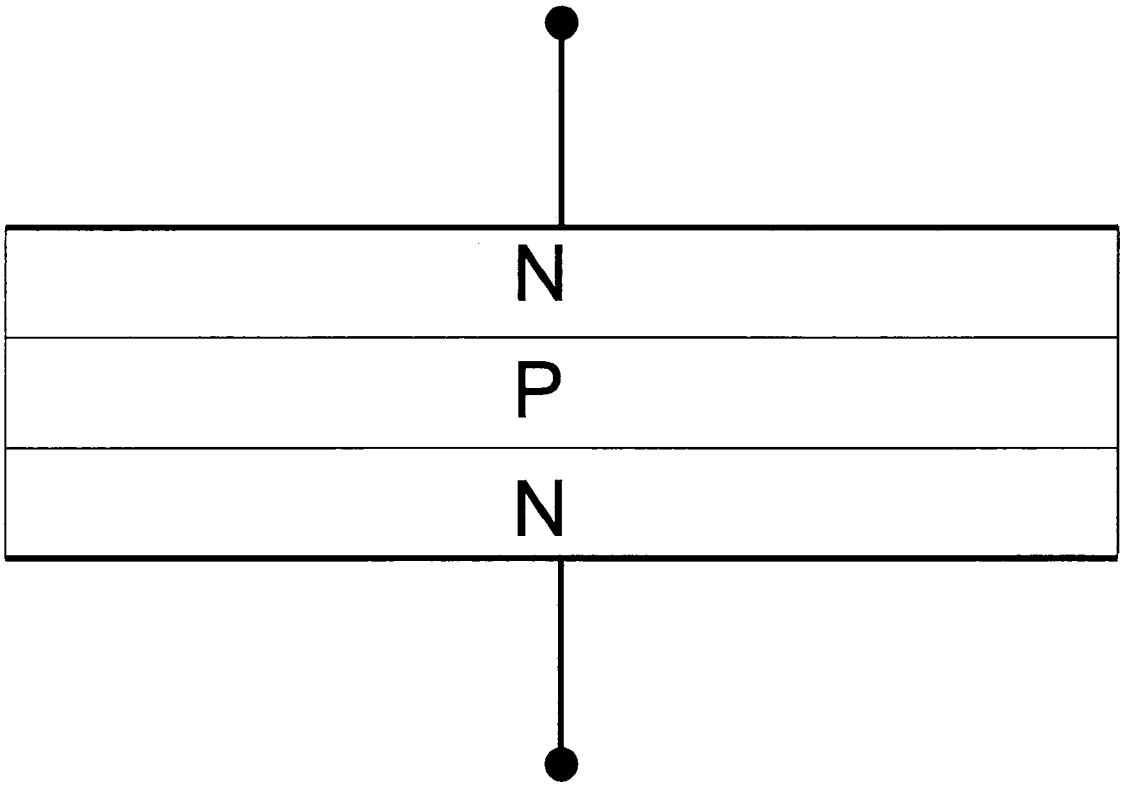
FIG. 1 and FIG. 1*a* show identical means of fabricating a high forward voltage drop bipolar junction diode or transistor bypass shunt device.
Figure 1A:
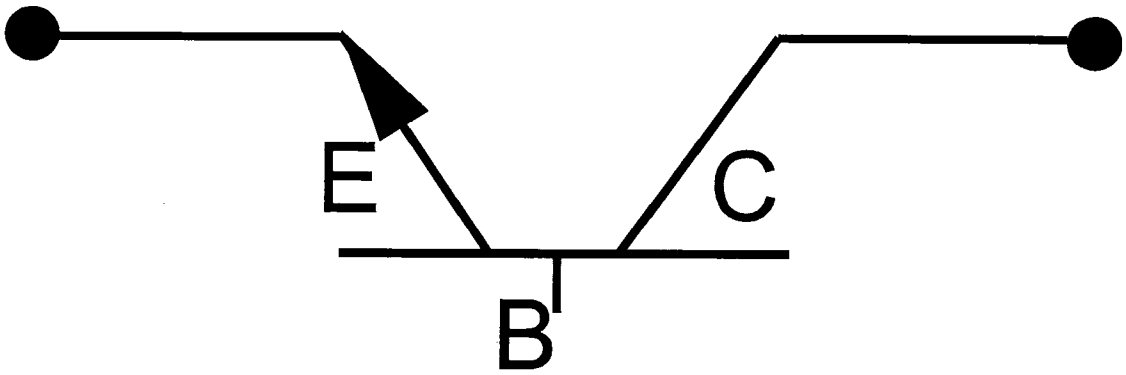

FIG. 1 and FIG. 1*a* show identical means of fabricating a high forward voltage drop bipolar junction diode or transistor bypass shunt device. While these drawings show NPN units, PNP units can also be fabricated as one skilled in the art knows. Diodes fabricated in this manner are unlike conventional diodes or Zener diodes as their IV curves are markedly different. Zener and conventional diodes have a positive slope to their IV curves. As current through these devices increase, so also does the voltage drop across the device increase. This is not true with the transistor bypass shunts described herein. The IV curve of this bi-directional junction diode type device described herein has an infinite to slightly less than infinite slope with increasing current.

Figure 4:
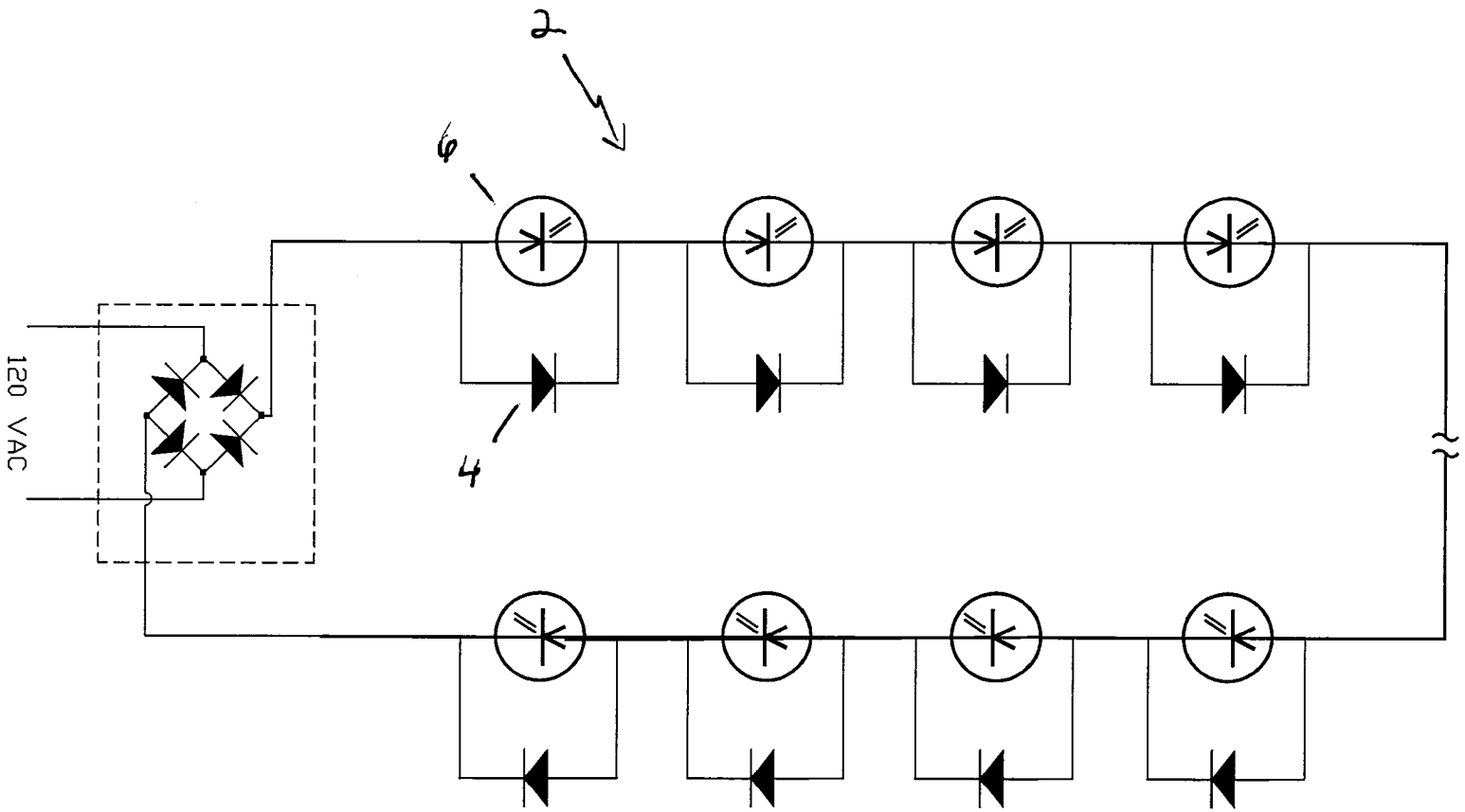
FIG. 4 shows a series wired light string with high voltage forward diodes as bypass shunts across LEDs.

A rectifier diode with a forward voltage drop of between 3 to 10 volts, preferably about 4 volts, would be ideal as a bypass shunt in LED light strings. The reverse breakdown voltage should be at least 5 volts or more. FIG. 4 shows a series-wired LED light string 2 with high forward voltage diodes 4 as bypass shunts across LEDs 6. While these non-Zener devices are not voltage regulators, voltage regulation is not important in low current LED light strings.

Figure 2:
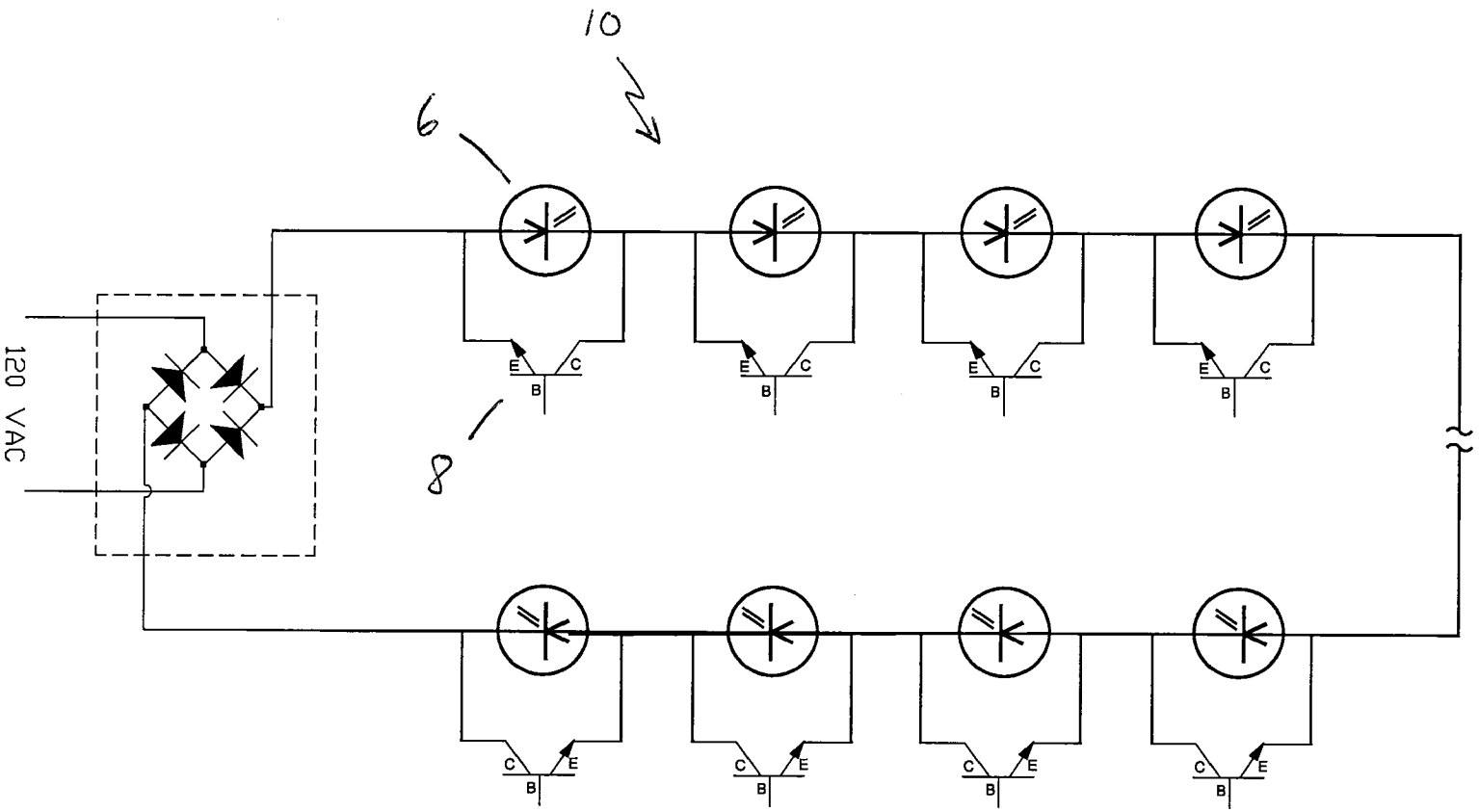
FIG. 2 shows, the preferred embodiment, a series wired light string with NPN transistor shunts.

The desired operating shunt voltage would be approximately 4 volts at approximately 25 milliamperes, although devices with shunt voltages as high as 10 volts can be used as bypass shunts in LED light strings. Laboratory tests have shown the shunt voltage to be around six to eight volts for small signal transistors such as 2N2222; 2N3904 & 2N4401 devices on most all units tested. While these are NPN transistors, and the drawing of a series wired string 10 in FIG. 2 shows NPN units 8, PNP transistors work equally well in the present invention. This is well known to one skilled in the art.

Figure 3:
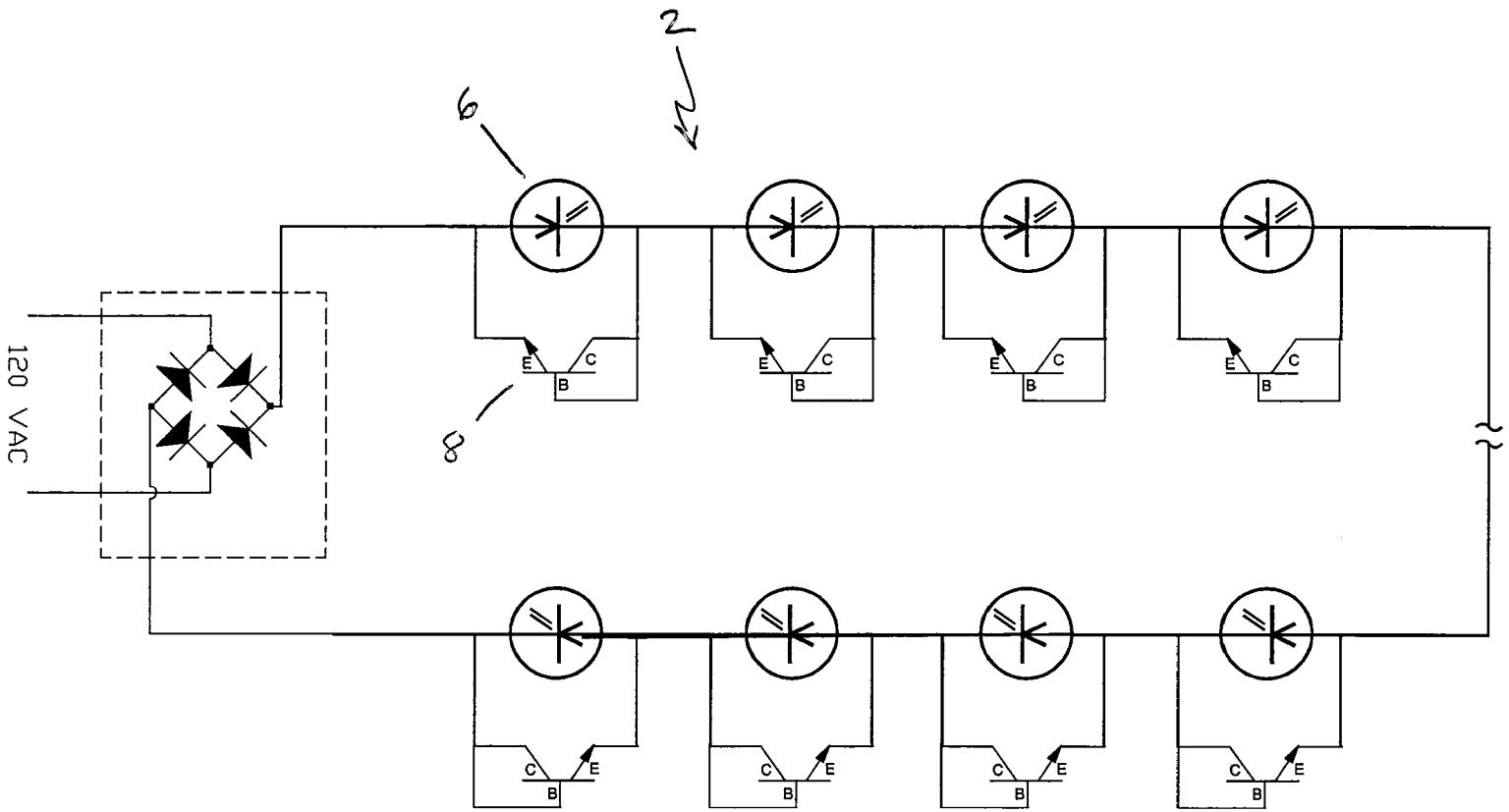
FIG. 3 shows a series wired light string with NPN transistor shunts in which the base and collector of the transistor shunts are tied together.

Depending on the transistors and LEDs used, different transistor terminals might be desired as shunts. This could include base to emitter with collector open or the base and collector tied together versus the emitter as shown in FIG. 3. However, as stated earlier, the preferred embodiment is shown in FIG. 2 where the transistors collector and emitter terminals are used with the base open.

The preferred packaging for the bipolar junction diode bypass shunt is an axial package, such as the DO-35.

Although the invention has been described in detail in connection with the exemplary embodiments, it should be understood that the invention is not limited to the above disclosed embodiments. Rather, the invention can be modified to incorporate any number of variations, alternations, substitutions, or equivalent arrangements not heretofore described, but which are commensurate with the spirit and scope of the invention. Accordingly, the invention is not limited by the foregoing description or drawings, but is only limited by the scope of the appended claims.

What is claimed is:

1. A series-wired light emitting diode (LED) light string that operates on DC voltage, comprising: a plurality of LEDs and a plurality of transistor bypass shunts, each shunt being electrically connected in parallel across a respective LED to maintain current flowing in the light string in the event that a corresponding LED is inoperative or is missing, each bypass shunt having a shunting voltage of more than three volts and less than ten volts, wherein each bypass shunt comprises a bipolar junction transistor with collector and emitter terminals connected to opposite sides of the LED, and with the transistor base terminal not connected.

2. A series-wired light emitting diode (LED) light string that operates on DC voltage, comprising: a plurality of LEDs and a plurality of transistor bypass shunts, each shunt being electrically connected in parallel across a respective LED to maintain current flowing in the light string in the event that a corresponding LED is inoperative or is missing, each bypass shunt having a shunting voltage of more than three volts and less than ten volts, wherein each bypass shunt comprises a bipolar junction transistor with collector and base terminals tied together and connected to one side of the LED and an emitter terminal connected to an opposite side of the LED.

3. A series-wired light emitting diode (LED) light string that operates on DC voltage, comprising: a plurality of LEDs and a plurality of transistor bypass shunts, each shunt being electrically connected in parallel across a respective LED to maintain current flowing in the light string in the event that a corresponding LED is inoperative or is missing, each bypass shunt having a shunting voltage of more than three volts and less than ten volts, wherein each bypass shunt comprises a bipolar junction transistor with emitter and base terminals connected to opposite sides of the LED, and with the transistor collector terminal not connected.

* * * * *